US007177549B2

(12) United States Patent
Matsushima et al.

(10) Patent No.: US 7,177,549 B2
(45) Date of Patent: Feb. 13, 2007

(54) HIGH-FREQUENCY TRANSMISSION LINE AND AN OPTICAL MODULE INCORPORATING THE SAME LINE

(75) Inventors: Naoki Matsushima, Yokohama (JP); Kazumi Kawamoto, Yokohama (JP); Hideyuki Kuwano, Yokohama (JP); Yoshiaki Niwa, Yokohama (JP); Tetsuya Kato, Fujisawa (JP)

(73) Assignee: OpNext Japan, Inc., Yokohama (JP)

( * ) Notice: Subject to any disclaimer, the term of this patent is extended or adjusted under 35 U.S.C. 154(b) by 838 days.

(21) Appl. No.: 10/222,480

(22) Filed: Aug. 16, 2002

(65) Prior Publication Data

US 2003/0202800 A1 Oct. 30, 2003

(30) Foreign Application Priority Data

Apr. 25, 2002 (JP) ..... 2002-123620

(51) Int. Cl.
*H04B 10/04* (2006.01)
*H04B 10/00* (2006.01)
*G02F 1/03* (2006.01)

(52) U.S. Cl. ..... 398/182; 398/117; 359/254

(58) Field of Classification Search ..... 398/117, 398/182; 359/254, 819; 365/88, 93; 333/245, 333/246, 249

See application file for complete search history.

(56) References Cited

U.S. PATENT DOCUMENTS 5,536,906 A * 7/1996 Haas et al. ..... 174/52.4
6,010,251 A * 1/2000 Koyanagi et al. ..... 385/93

FOREIGN PATENT DOCUMENTS

| | | | |
|---|---|---|---|
| JP | 64-060008 | A | 3/1989 |
| JP | 01-198804 | A | 8/1989 |
| JP | 06-104612 | A | 4/1994 |
| JP | 10-197836 | | 7/1998 |
| JP | 10-197836 | A | 7/1998 |
| JP | 2000-057349 | A | 2/2000 |
| JP | 2000-114801 | A | 4/2000 |

* cited by examiner

*Primary Examiner*—Jason Chan
*Assistant Examiner*—Quan-Zhen Wang
(74) *Attorney, Agent, or Firm*—Townsend and Townsend and Crew LLP

(57) ABSTRACT

A transmission line with a bending portion is provided, which line comprises any one of a coplanar line, another coplanar waveguide line formed on the dielectric substrate under which a ground layer is provided and a coplanar strip line. A chamfered portion is provided on the outer angular portion of the bending portion of the signal wiring conductor and a triangular conductor is disposed to an inner angular portion thereof. Given that length of the chamfered portion is defined as a, and length of the wiring edge side of the triangular conductor is defined as b and width of the signal wiring conductor is defined as c, it is arranged such that a is greater than b+c×square root of 2. Thereby, a transmission line or an optical module of smaller reflection loss at the bending portion thereof and of improved high-frequency characteristics is provided.

4 Claims, 6 Drawing Sheets

HIGH-FREQUENCY TRANSMISSION LINE AND AN OPTICAL MODULE INCORPORATING THE SAME LINE

FIELD OF THE INVENTION

The present invention relates to a high-frequency transmission line and an optical module incorporating the same line, especially, pertaining to such transmission line as being capable of converting a signal transmission direction and being good at high-frequency characteristics and an optical module incorporating the same line.

DESCRIPTION OF THE RELATED ART

In an optical communication field, the data tend to be received and transmitted by a higher and higher bit rate year by year in accordance with the development of advanced information system. As to a laser module to transmit an optical signal by an optical modulator too, in order to transfer an optical signal of a higher bit rate from a transmitter to a receiver without fail, it is essential to improve the high-frequency characteristics of the transmission line that transmits an electrical signal to the optical modulator.

FIG. 8 shows an upper surface view of the inside of the prior optical module wherein a modulator integration semiconductor laser 21 is adopted as an optical modulator. The beam emitted from the semiconductor laser 21 is converged through a lens 22 so as to be transmitted to an optical fiber 23. The semiconductor laser 21 is provided on a substrate 24 made of a dielectric material. On the surface of which substrate a high-frequency transmission line 25 is formed so as to be electrically connected to the semiconductor laser 21 via a bonding wire 30. The transmission line 25 is of a coplanar waveguide type wherein a signal wiring conductor is interposed between ground wiring conductors in the same plane.

A relay substrate 29, on the surface of which a transmission line 27 is formed, is disposed between a signal input transmission line 26 of a module package 28 and the transmission line 25 of the substrate 24. The transmission line are electrically connect to one another by bonding wires 31 and 32 so that it is arranged such that a high-frequency signal is input to the semiconductor laser 21 from the exterior of the package.

Besides the coplanar line, a high-frequency transmission line includes a coplanar line with a ground layer provided below the dielectric substrate in which the coplanar line is formed and a coplanar strip line arranged such that there is missing one side of ground lines in the coplanar line.

The transmission lines formed in the respective substrates are standardized in dimension such that the characteristic impedance thereof becomes 50Ω so as to prevent reflection loss owing to the impedance mismatch. Further, the bonding wires that interconnect the respective lines are standardized in disposition and dimension as appropriate so as to minimize reflection loss. As a result, the transmission lines become good at high-frequency characteristics, and an optical module incorporating such transmission lines becomes good at transmission characteristics over broadband.

The location of the terminal provided with the signal input transmission line in the optical module shown in FIG. 8 is prescribed in light of the connection with a transmitter or a transceiver. On the contrary, an optical module that adopts another lens anterior to the optical fiber 23 or the module with two pieces of lenses in use is required to arrange such that the end portion of the optical fiber 23 is positioned to the focal point of another lens, the interval between another lens and a lens 30 and the location of the semiconductor laser 21 are selectable relatively in an arbitrary manner. Accordingly, the optical module with two pieces of lenses in use adopts a linear transmission line 27 shown in FIG. 8. The optical module shown in FIG. 8 is arranged such that the signal input transmission line and the semiconductor laser 21 of the module package are connected through a linear transmission line running substantially vertical with regard to the optical propagation direction and with no bending portion provided therein. There is no problem where the structure of the optical module allows for such arrangement, but there are cases where the restraints involved with optical disposition, parts size and packaging process and as such make such arrangement impossible. For instance, as for the optical module with the sole piece of lens provided therein, it is required that the light emitted from the optical modulator integration semiconductor laser 21 is arranged through the lens to focus on the end portion of the optical fiber 23. Thus, the interval between the lens 30 and the end portion of the optical fiber is predetermined. Accordingly, the location of the optical modulator integration semiconductor laser 21 is prescribed. However, as mentioned above, the location of the terminal provided with the signal input transmission line in light of the connection with a transmitter or transceiver is prescribed, so that there are some cases where the linear transmission line 27 is not adopted.

Such cases include where the signal input transmission line exists anterior or posterior to the location thereof shown in FIG. 8 along the optical propagation direction and where the signal input line runs in parallel to such direction.

Those cases are coped with by adopting a high-frequency transmission line provided with a bending portion.

FIG. 9 is an upper surface view of the bending portion of the prior high-frequency transmission line. FIG. 9A shows the structure of the bending portion thereof where a signal wiring conductor and ground wiring conductors substantially rectangularly fold back, while FIG. 9B shows where a chamfered portion is formed at an outer angular section of the signal wiring conductor. As shown therein, the respective high-frequency transmission lines 1*a* and 1*b* are arranged in the same plane as a coplanar line that comprises the respective signal wiring conductors 11*a* and 11*b* and ground wiring conductors 12*a* and 13*a* and 12*b* and 13*b* as disposed at each side of the respective signal wiring conductors 11*a* and 11*b*. Besides the structure of such simple bending portion that is obtained by rectangularly folding back a wiring of a uniform width as shown in FIG. 9A, the adoption of such structure of the signal wiring conductor as disclosed in e.g. Japanese Patent Laid-open No.10-197836 and shown in FIG. 9B wherein a chamfered portion 111*b* is formed at an outer angular section of the signal wiring conductor 11*b* allows reflection loss to be alleviated to some extent.

A high-frequency transmission line such as a microstrip-line, a tri-plate line and a coplanar line that are provided on or in a dielectric substrate and comprise a signal wiring conductor with a given width and ground layers is disclosed in Japanese Patent Laid-open No.2000-114801 wherein the first and second signal wiring conductors disposed in the same plane with a given angle along the signal transmission direction are interconnected by means of a conductor taking as line edges two lines, the respective of which lines linearly connects the inner angular portions of the first and second signal wiring conductors and the outer angular portions thereof. This prior art alleviates reflection loss in the bending portion of the signal wiring conductors to some extent.

SUMMARY OF THE INVENTION

However, the reflection loss as caused by such arrangement as disclosed in the above prior art is not disregarded, especially when it is applied to an optical module with a higher bit rate. This is because capacitance component and as such occurs between the edge sides of e.g. the signal wiring conductor 11*b* interposing the inner angular portions thereof so that the characteristic impedance thereof does not meet a value as desired, even if the shape of the vertical cross section of the bending portion with regard to the signal propagation direction is arranged such that the characteristic impedance thereof amounts to a value as desired. Further, in such a transmission line structure provided with ground lines in the same plane as a coplanar line, the same circumstances as mentioned above occurs at the bending portion of the transmission line between the respective signal wiring conductors 11*a* and 11*b* and ground wiring conductors, which results in the increase of reflection loss.

Further, the conductor adopted in the prior art as disclosed in Japanese Patent Laid-open No.2000-114801 is large in line width so as to increase the capacitance component thereof while to decrease the characteristic impedance thereof, with the result that reflection loss occurs.

An object of the present invention is to provide a high-frequency transmission line that is good at high-frequency characteristics even where a bending portion exists in the same line and an optical module of a higher bit rate incorporating the same line.

Another object of the present invention is further to provide an optical module incorporating one piece of lens and a high-frequency transmission line provided with a bending portion.

In order to solve the above issues, a high-frequency transmission line according to the first aspect of the present invention comprises a substrate, a first signal wiring conductor provided on or in the substrate, a second signal wiring conductor provided on or in the substrate and disposed such that it substantially intersects with the first signal wiring conductor and a bending portion to interconnect the first and second signal wiring conductors, wherein an outer side of the bending portion is chamfered so as to form an outer signal conductor intermediary side, and a triangular conductor is provided to an inner side of the bending portion so as to form an inner signal conductor intermediary side, wherein given that length of the outer signal conductor intermediary side is defined as a and that of the inner signal conductor intermediary side is defined as b and width of the respective first and second signal wiring conductors is defined as c, it is arranged such that a is larger than (b+c×square root of 2).

The prior art disclosed in Japanese Patent Laid-open No.2000-114801 is arranged such that a is substantially equal to (b+c×square root of 2), so that the capacitance component of the conductor adopted in the bending portion of the transmission line is larger than the counterpart of the present invention. Thus, the characteristic impedance of the conductor disclosed therein is smaller than that of the bending portion of the transmission line according to the present invention so as to increase reflection loss.

A high-frequency transmission line according to the second aspect of the present invention comprises a substrate, a first signal wiring conductor provided on or in the substrate, a second signal wiring conductor provided on or in the substrate and disposed such that it substantially intersects with the first signal wiring conductor and a bending portion to interconnect the first and second wiring conductors, wherein an outer side of the bending portion is chamfered so as to form an outer signal conductor intermediary side, and a triangular conductor is provided to an inner side of the bending portion so as to form an inner signal conductor intermediary side, wherein given that width of the respective first and second signal wiring conductors is defined as c and length of the inner signal conductor intermediary side projected to a plane to cross with one of the first and second signal wiring conductors is defined as e and length of the outer signal conductor intermediary side projected to the plane is defined as f, it is arranged such that f is larger than (c+e).

A high-frequency transmission line according to the third aspect of the present invention comprises a substrate, a first signal wiring conductor provided on or in the substrate, a second signal wiring conductor provided on or in the substrate and disposed such that it substantially intersects with the first signal wiring conductor and a bending portion to interconnect the first and second signal wiring conductors, wherein an outer side of the bending portion is chamfered so as to form an outer signal conductor intermediary side and a triangular conductor is provided to an inner side of the bending portion so as to form an inner signal conductor intermediary side, wherein given that a point at which an outer signal conductor side of the first signal wiring conductor intersects with the outer signal conductor intermediary side is defined as a first point and a point at which an inner signal conductor side of the first signal wiring conductor intersects with the inner signal conductor intermediary side is defined as a second point while a point at which an outer signal conductor side of the second signal wiring conductor intersects with the outer signal conductor intermediary side is defined as a third point and a point at which an inner signal conductor side of the second signal wiring conductor intersects with the inner signal conductor intermediary side is defined as a fourth point, it is arranged such that an angle that a first line to connect the first and second points makes with a second line to connect the third and fourth points is larger than 90°.

A high-frequency transmission line according to the fourth aspect of the present invention comprises a substrate, a first signal wiring conductor provided on or in the substrate, a second signal wiring conductor provided on or in the substrate and disposed such that it substantially intersects with the first signal wiring conductor and a bending portion to interconnect the first and second signal wiring conductors, wherein an outer side of the bending portion is chamfered so as to form an outer signal conductor intermediary side and a triangular conductor is provided to an inner side of the bending portion so as to form an inner signal conductor intermediary side such that the inner signal conductor intermediary side runs in parallel to the outer signal conductor intermediary side, wherein given that width of the respective first and second signal wiring conductors is defined as c, and width that runs crosswise with the outer and inner signal conductor intermediary sides is defined as g, it is arranged such that g is less than c divided by square root of 2.

In a fifth aspect according to any one of the above first to fourth aspects, a ground wiring conductor provided with a bending portion is disposed to the inner side of the signal wiring conductor constituted of the first and second signal wiring conductors and the bending portion, and the angular portion of the bending portion of the ground wiring conductor is chamfered so as to form an outer ground conductor intermediary side.

In a sixth aspect according to the fifth aspect, given that length of the outer ground conductor intermediary side is defined as d and that of the inner ground conductor intermediary side is defined as b, it is arranged in such relation as 0.5b<d<1.5b.

In a seventh aspect according to any one of the above first to fourth aspects, a ground wiring conductor is disposed to the outer side of the signal wiring conductor constituted of the first and second signal wiring conductors and the bending portion, and a point at which a first side of the ground conductor opposite to the first signal wiring conductor intersects with a second side thereof opposite to the second signal wiring conductor corresponds to the angular portion.

In an eighth aspect according to any one of the above first to fourth aspects, a third signal wiring conductor to substantially intersect with the second signal wiring conductor is arranged so as to provide another bending portion between the second and third signal wiring conductors.

In a ninth aspect, an optical module comprises a module package, an optical modulator integration semiconductor laser, a piece of lens to irradiate light emitted from the semiconductor laser to an end portion of an optical fiber provided outside of the module package such that the light focuses on the end portion thereof and a high-frequency transmission line to supply a high-frequency signal output from the outside of the module package to the semiconductor laser, which high-frequency transmission line corresponds to any one of those according to the above first to fourth aspects.

These and other objects, features and advantages of the invention will be apparent from the following more particular description of preferred embodiments of the invention, as illustrated in the accompanying drawings.

DESCRIPTION OF THE PREFERRED EMBODIMENTS

The preferred embodiments of the present invention are described with reference to the accompanying drawings.

Figure 1A:
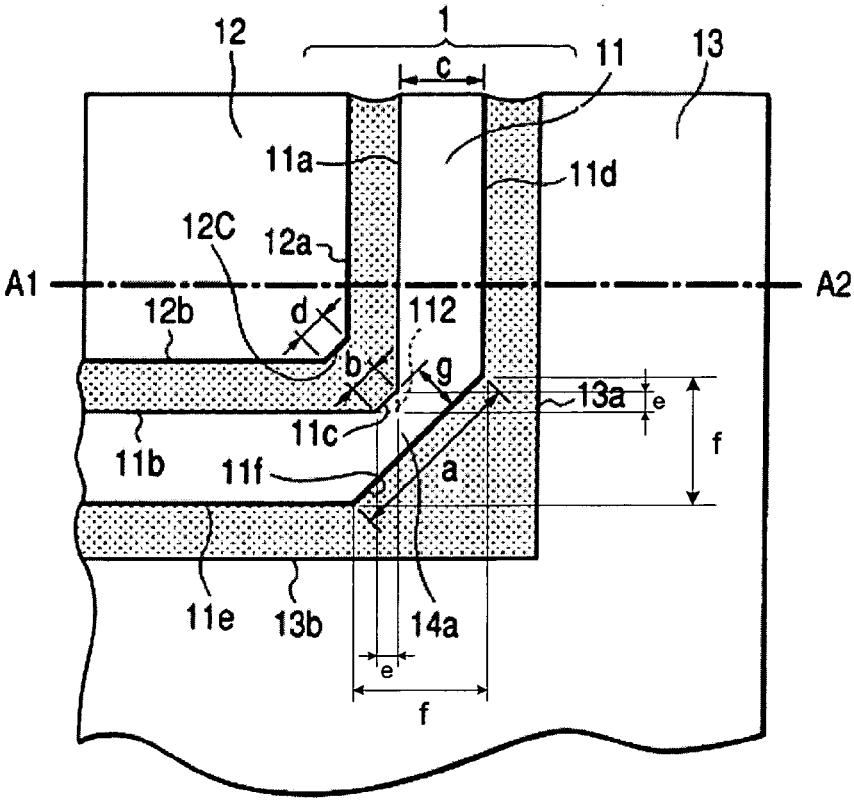
FIG. 1A is a plan view of a high-frequency transmission line according to the first embodiment of the invention.
Figure 1B:
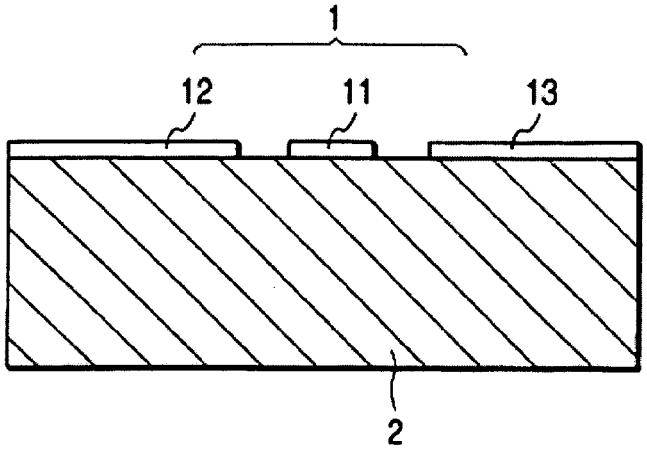
FIG. 1B is a sectional view of the high-frequency transmission line taken along A1–A2 of FIG. 1A.

FIG. 1A is a plan view of a high-frequency transmission line according to the first embodiment of the present invention, while FIG. 1B is a sectional view of the high-frequency transmission line taken along A1–A2 of FIG. 1A. As shown therein, a high-frequency transmission line 1 has a coplanar line configuration and comprises a signal wiring conductor 11 formed on a substrate 2 and ground wiring conductors 12 and 13 disposed at the respective sides of the signal wiring conductor 11. The substrate 2 is made of a dielectric material or alumina ($Al_2O_3$) and a gold thin film is adopted for the respective wiring conductors. The high-frequency transmission line is designed according to the dimensions prescribed for the width of the transmission direction of the signal wiring conductor 11 or the vertical direction thereof with regard to the transmission line and the interval between the respective ground wiring conductors such that the characteristic impedance of the signal wiring conductor amounts to 50Ω in the linear portion thereof. Also, the angle of a bending portion 14*a* thereof is defined as 90° while the width of the signal wiring conductor 11 is constant through the whole linear section thereof.

At the bending portion 14*a* disposed between inner signal conductor sides 11*a* and 11*b* of the signal wiring conductor 11 shown in FIG. 1A, capacitance occurs between them. In order to retrain capacitance from increasing, it is arranged such that a triangular wiring conductor 112 made of the same material as the signal wiring conductor 11 is provided to the bending portion 14*a*. That is, as shown in FIG. 1A, it is arranged such that an inner signal conductor intermediary side 11*c* is provided by integrally providing the triangular wiring conductor 112 at an angular portion formed between the inner signal conductor sides 11*a* and 11*b* of the signal wiring conductor 11 so as to do away with such angular portion. This arrangement reduces capacitance to be generated between those sides 11*a* and 11*b*. To note, the dotted line as shown in FIG. 1A is for the convenience's sake only.

Further, an outer signal conductor intermediary side 11*f* is formed by chamfering the outer angular portion of the signal wiring conductor 11 or that disposed between the outer signal conductor sides 11*d* and 11*e*. It is arranged such that the inner signal conductor intermediary side 11*c* runs parallel to the outer signal conductor intermediary side 11*f*. Given that the width of the signal wiring conductor 11 or that between the inner signal conductor sides 11*a* and the outer signal conductor side 11*d* as well as that between the inner signal conductor side 11*b* and the outer signal conductor side 11*e* are defined as c, it is arranged such that the width between the inner signal conductor intermediary side 11*b* and the outer signal conductor intermediary side 11*f* is smaller than the width c, which means that the width of the bending portion 14*a* of the signal wiring conductor 11 is narrowed so as to increase inductance.

The characteristic impedance of the signal wiring conductor 11 is proportionate to the square root of L divided by C, given that inductance is defined as L and capacitance is defined as C. Even if the inner signal conductor intermediary side 11*c* is provided as shown in FIG. 1A so as to restrain capacitance from increasing, it notwithstanding increases to some extent in comparison with the counterpart of the linear signal wiring conductor. Thus, in the present invention, the characteristic impedance of the signal wiring conductor is kept substantially constant by narrowing the wiring conductor in the vicinity of the bending portion thereof so as to increase inductance.

On a trial basis or for simulation, given that the length of the outer signal conductor intermediary side 11*f* is defined as a and that of the inner signal conductor intermediary side 11*c* at the inner angular portion of the signal wiring conductor is defined as b while the vertical sectional width of the signal wiring conductor 11 with regard to the transmission direction thereof or that between the inner and outer signal conductor sides 11*a* and 11*d* or that between the inner and outer signal conductor sides 11*b* and 11*e* is defined as c, it is found that the high-frequency characteristics of the signal wiring conductor improves by defining that a is greater than (b+c×square root of 2). The embodiment shown in FIG. 1 defines a as being equal to 2b+c×square root of 2, which satisfies the above greater than relation.

Further, as shown in FIG. 1A, the angular portion of a ground wiring conductor 12 provided on an inner side of the bending portion 14*a* of the signal wiring conductor 11 is chamfered so as to provide an outer ground conductor intermediary side 12*c* between the outer ground conductor sides 12*a* and 12*b*. As a result that the additional portion 112 is provided with the signal wiring conductor 11 so as to form the inner signal conductor intermediary side 11*c*, the interval between the intersecting point of the outer ground conductor sides 12*a* and 12*b* and the inner signal conductor intermediary side 11*c* becomes nearer so as to increase capacitance.

In order to solve this inconvenience, an outer side of the ground wiring conductor 12 is chamfered so as to form an outer ground conductor intermediary side 12*c*. It is found on a trial basis that the length d of the outer ground conductor intermediary side 12*c* is preferably defined in relation to the length b of the inner signal conductor intermediary 11*c* as 0.5b<d<1.5b. As for a ground wiring conductor 13 formed at the outer angular portion of the bending portion 14*a*, there is not provided a chamfered portion between the inner ground conductor sides 13*a* and 13*b*, but an angular portion is formed at the intersecting point between them.

The embodiment shown in FIG. 1 is further arranged as follows, which arrangement allows the impedance of the signal wiring conductor to keep substantially constant and the high-frequency characteristics of the transmission line to keep intact, even when the signal wiring conductor is bent substantially into rectangle.

(1) Given that the length of one of the first and second signal wiring conductors substantially bent in rectangle, which length is obtained by projecting one of those conductors to a plane crossing therewith, is defined as c and the length of the inner signal conductor intermediary side 11*c*, which length is obtained by projecting the same side to a plane crossing therewith, is defined as e so as to obtain the addition of (c+e), and the length of the outer signal conductor intermediary side 11*f*, which length is obtained by projecting the same side to the same plane as mentioned above, is defined as f, it is arranged such that f is greater than (c+e). This improves the high-frequency characteristics of the transmission line.

(2) Given that a line connecting the intersecting point between the inner signal conductor side 11*a* and the inner signal conductor intermediary side 11*c* with that between the outer signal conductor side 11*d* and the outer signal conductor intermediary side 11*f* is defined as a first line and a line connecting the intersecting point between the inner signal conductor side 11*b* and the inner signal conductor intermediary side 11*c* with that between the outer signal conductor side 11*e* and the outer signal conductor intermediary side 11*f* is defined as a second line, the lengths of the inner and outer signal conductor intermediary sides 11*c* and 11*f* are defined such that an angle that the first line makes with the second line amounts to 90 degrees or more. This improves the high-frequency characteristics of the transmission line.

(3) Viewed from a different standpoint, given that the width between the inner signal conductor intermediary side 11*c* and the outer signal conductor intermediary side 11*f* arranged such that those sides are in parallel to each other or the length between the respective points of those respective sides, between which points a line crosses over, is defined as g and the sectional width of the signal wiring conductor 11 excluding the bending portion 14*a* thereof, which width is in vertical relation to the transmission direction thereof, is defined as c, the width g between the inner and outer signal conductor intermediary sides 11*c* and 11*ff* is defined such that g is smaller than divided by square root of 2. This improves the high-frequency characteristics of the transmission line.

Figure 2:
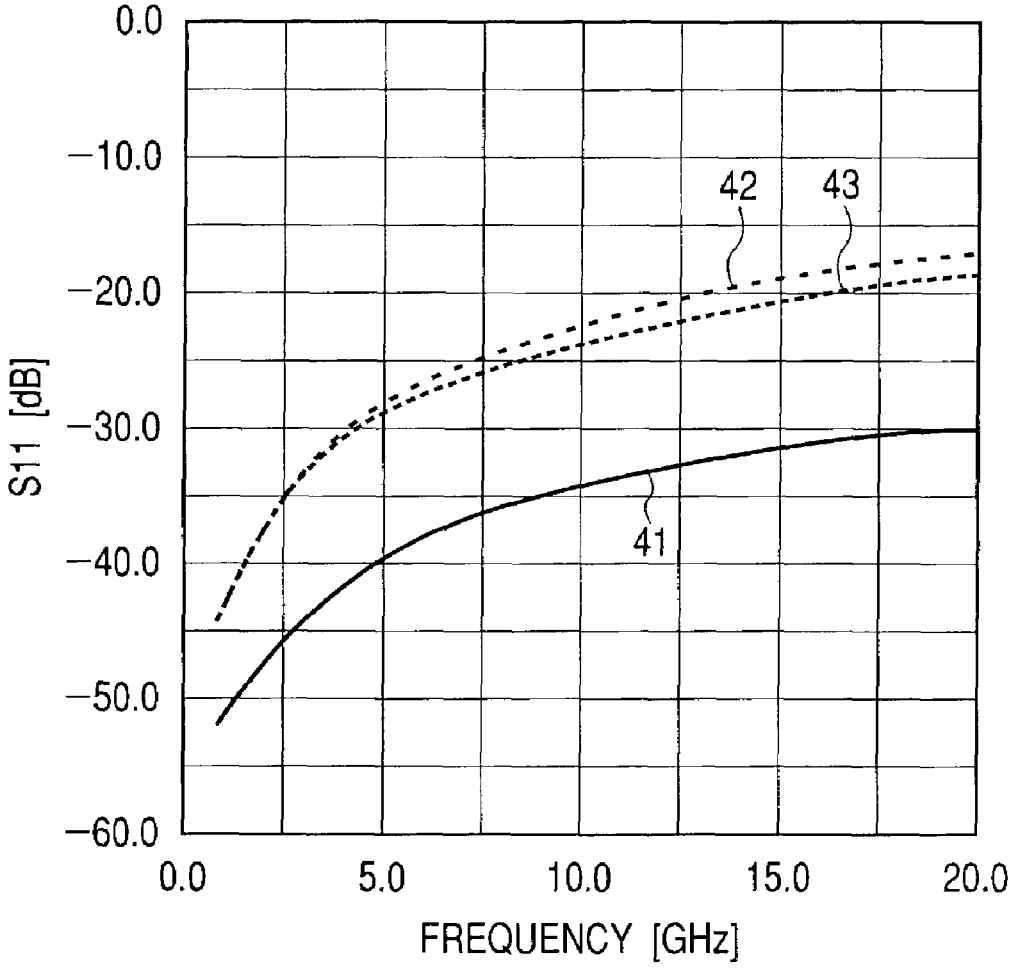
FIG. 2 is a curve graph to show the return loss characteristics of the high-frequency transmission line shown in FIG. 1.
Figure 9A:
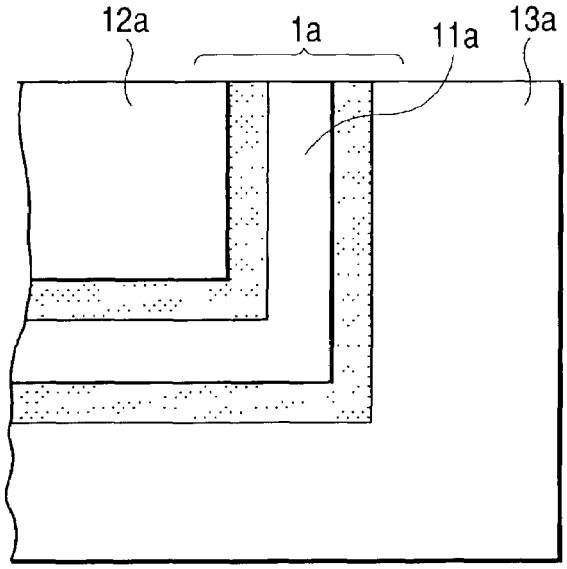
FIG. 9A PRIOR ART
FIGS. 9A and 9B are upper surface views of the bending portions of the prior high-frequency transmission lines.
Figure 9B:
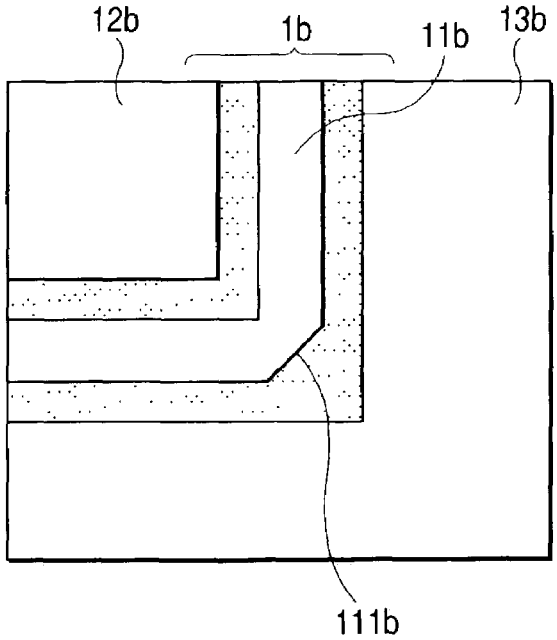
FIG. 9B PRIOR ART

FIG. 2 is a curve graph to show the reflection characteristics of the high-frequency transmission line shown in FIG. 1, wherein the transverse axis indicates frequency and the vertical axis indicates the reflection characteristics thereof S11, in which the calculation result of the reflection characteristics S11 of the high-frequency transmission line shown in FIG. 1 under the simulation of the electromagnetic field. The curve 41 shows the characteristic of the transmission line shown in FIG. 1. The curve 42 shows the characteristic of the prior transmission line having a bending portion shown in FIG. 9A, and the curve 43 shows that of another prior example provided with a bending portion shown in FIG. 9B.

As clear from the drawings, it is found that the transmission line according to the above embodiment is subjected to smaller reflection loss especially in the high-frequency area in comparison with the prior transmission lines, which implies a better transmission characteristic in such area.

The return loss characteristics shown in FIG. 2 results from the fact that there is small fluctuation in the characteristic impedance of the bending portion 14*a* of the high-frequency transmission line shown in FIG. 1. In the prior arts shown in FIGS. 9A and 9B, the sectional impedance at the angular portion of the signal wiring conductor is not only displaced from a given value, but also capacitance occurs at the inner angular portion thereof as well as the capacitance fluctuates between the inner angular portion thereof and the corresponding portion of the ground wiring conductor, which generates reflection.

On the other hand, the high-frequency transmission line according to the present invention shown in FIG. 1 restrains the sectional impedance of the angular portion of the signal wiring conductor from fluctuating by chamfering the outer angular portion thereof and prevents capacitance from occurring between the signal wiring conductor sides by providing a triangular conductor on the inner angular portion thereof and further restrains capacitance from fluctuating between the inner angular portion of the signal wiring conductor and the corresponding portion of the ground wiring conductor by chamfering the latter portion. The afore-mentioned definition of the dimensions of the inner and outer signal conductor intermediary sides 11*c* and 11*f* and so forth is effective for alleviating return loss, which allows a transmission line of better high-frequency characteristic to be provided.

To note, a coplanar line is adopted for the transmission line in the embodiment shown in FIG. 1, but it may be a coplanar line with a ground layer provided either on the backside of or inside the dielectric substrate.

In this embodiment, alumina is adopted for the substrate 2, but it may be ceramics such as aluminium nitride (AIN), n organic insulation film or a semiconductor such as silicone. The signal wiring conductor and the ground wiring conductor are made of gold, which maybe made of silver or copper. However, they are preferably made of a material of lower specific resistance in light of conductor loss.

Then, the second embodiment of the present invention is described with reference to FIG. 3.

Figure 3:
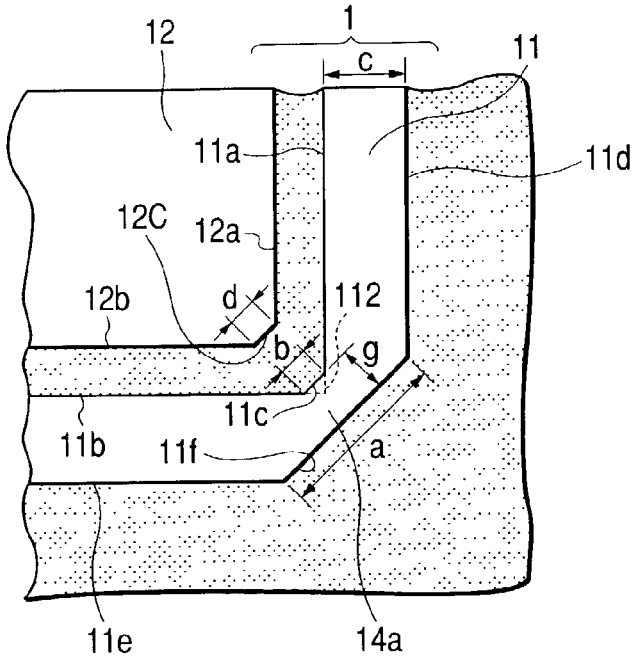
FIG. 3 is a plan view of the high-frequency transmission line according to the second embodiment of the present invention.
Figure 4:
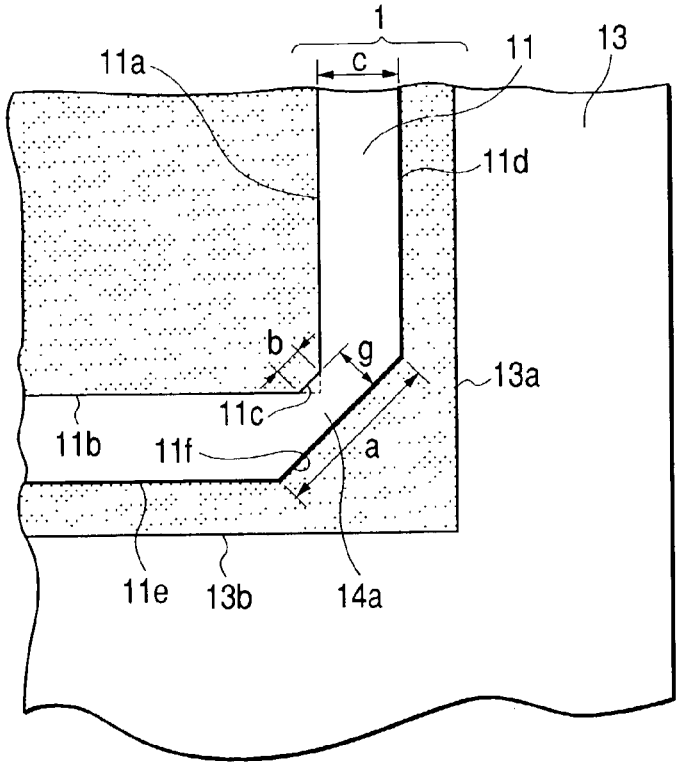
FIG. 4 is a plan view of the high-frequency transmission line according to the third embodiment of the present invention.

FIG. 3 is a plan view of the high-frequency transmission line according to the second embodiment, and FIG. 4 is a plan view thereof according to the third embodiment thereof. The same structural elements shown in FIG. 1 are indicated with the same references, and the explanation thereof is omitted for redundancy.

In the embodiments shown in FIGS. 3 and 4, the high-frequency transmission line 1 is a coplanar strip line wherein either the ground wiring conductors 12 or 13 is disposed on one side of the signal wiring conductor 11 in the same plane. The signal wiring conductor 11 and the ground wiring conductor 12 are formed on the substrate 2 in the same way as shown in FIG. 1. In the case of the coplanar strip line, the line configuration depends on whether the ground wiring conductor lies in the outer side of the bending portion 14*a* or in the inner side thereof. FIG. 3 shows the ground wiring conductor 12 laid in the inner side of the bending portion 14*a* while FIG. 4 shows the same conductor laid in the outer side thereof. In either of those embodiments, the configuration of the signal wiring conductor 11 is the same as shown in FIG. 1. Given that the length of the chamfered outer angular portion thereof or that of the outer signal conductor intermediary side 11*f* is defined as a and the length of the inner signal conductor intermediary side 11*c* provided at the inner angular portion thereof is defined as b and the sectional width vertical with regard to the transmission direction of the signal wiring conductor 11 excluding the bending portion 14*a* thereof is defined as c, the configuration thereof is expressed as a being equal to 2b+c×square root of 2.

As shown in FIG. 3, where the ground wiring conductor 12 lies in the inner side of the signal wiring conductor, it is preferable that the outer angular portion of the ground wiring conductor 12 is chamfered so as to form the outer ground conductor intermediary side 12*c*. The length d of the outer ground conductor intermediary side 12*c* is equal to b in the same way as shown in FIG. 1. Where the ground wiring conductor lies in the outer side of the signal wiring conductor, as shown in FIG. 4, it is preferably arranged such that the inner ground conductor side 13*a* intersects with the inner ground conductor side 13*b* and the intersecting point between those sides forms an angular portion. The material adopted for the transmission line 1 and the substrate 2 is the same as those of the first embodiment. The second and third embodiments are arranged in the same way as described in (1) to (3) of the first embodiment.

The above arrangement allows a transmission line of smaller return loss loss in the high-frequency area and of better high-frequency characteristics to be provided in the same way as the first embodiment.

Then, the fourth embodiment is described with reference to FIG. 5.

Figure 5:
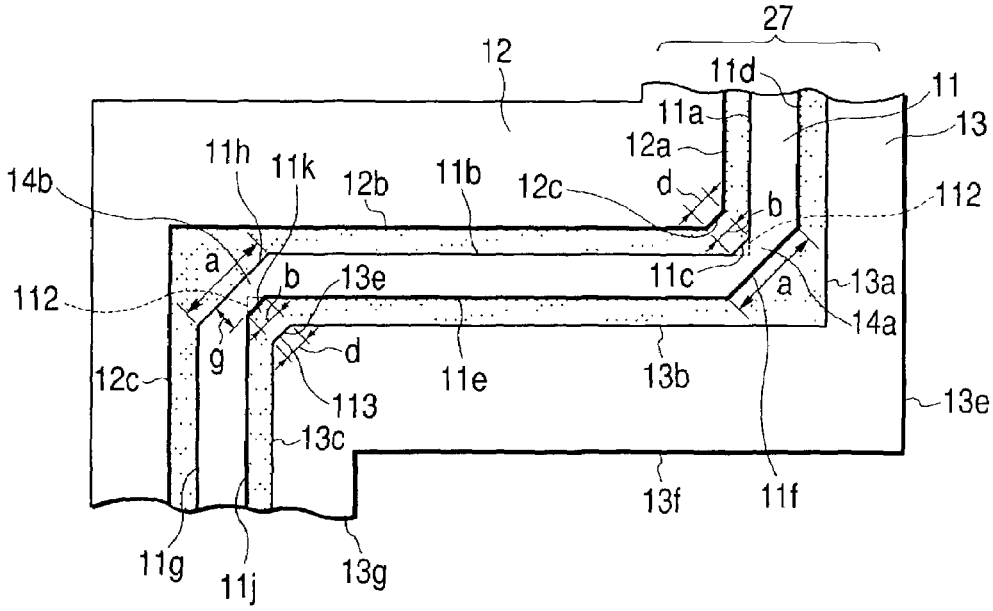
FIG. 5 is a plan view of the high-frequency transmission line according to the fourth embodiment of the present invention.

FIG. 5 is a plan view of the high-frequency transmission line according to the fourth embodiment of the present invention.

The high-frequency transmission line 27 of this embodiment is provided with two bending portions 14*a* and 14*b*. The configuration of the transmission line is a coplanar line in the same as shown in FIG. 1 comprising the signal wiring conductor 11 and the ground wiring conductors 12 and 13 disposed at the respective sides of the conductor 11, which conductors are disposed in the same plane. The bending portion 14*a* is formed in the same way as shown in FIG. 1. The bending portion 14*b* is point-symmetrically positioned to the bending portion 14*a*. An inner ground conductor side 12*c* is provided in the ground wiring conductor 12, which side intersects with the inner ground wiring side 12*b*. An inner signal conductor side 11*g* is provided in the signal wiring conductor 11, which side intersects with the inner signal conductor side 11*b*, and an inner signal conductor intermediary side 11*h* is provided between the inner signal conductor sides 11*b* and 11*g*. Further, an outer signal conductor side 11*j* is provided in the signal wiring conductor 11, which side intersects with the outer signal conductor side 11*e*, and an outer signal conductor intermediary side 11*k* is provided between the outer signal conductor sides 11*e* and 11*j*. Moreover, an inner ground conductor side 13*c* is provided in the ground wiring conductor 13, which side intersects with the inner ground conductor side 13*b*, and an inner ground conductor intermediary side 13*d* is disposed between the inner ground conductor sides 13*b* and 13*c*. An outer ground conductor side 13*e* intersects with an outer ground conductor side 13*f*, which side 13*f* intersects with an outer ground conductor side 13*g*.

Also in the fourth embodiment, given that the length of the outer signal conductor intermediary side 11*f* and the inner signal conductor intermediary side 11*h* respectively is defined as a, and the length of the inner signal conductor intermediary side 11*c* and the outer signal conductor intermediary side 11*k* respectively is defined as b and the sectional width vertical with regard to the transmission direction of the signal wiring conductor is defined as c, the configuration of the transmission line is expressed as a being equal to 2b+c×square root of 2. It is preferable that an outer ground conductor intermediary side 12*c* is provided by chamfering an intersecting portion between the outer ground conductor sides 12*a* and 12*b* of the ground wiring conductor 12 positioned to the inner side of the angular portion of the signal wiring conductor 11. Likewise, it is preferable that an inner ground conductor intermediary side 13*d* is provided between the inner ground conductor sides 13*b* and 13*c*. Given that the length of the outer ground conductor intermediary side 12*c* and the inner ground conductor intermediary side 13*d* respectively is defined as d, it is arranged such that the length d is equal to the length b in the same way as shown in FIG. 1. It is preferable that the intersecting points between the inner ground conductor sides 12*b* and 12*c* as well as between the outer ground conductor sides 13*f* and 13*g* take an angular shape.

The respective bending portions 14*a* and 14*b* of the fourth embodiment are arranged in the same way as described at (1) to (3) of the first embodiment.

The above arrangement, in the same way as the first embodiment, allows a transmission line of smaller return loss in the high-frequency area and of better high-frequency characteristics to be provided.

The material adopted for the transmission line 1 and the substrate 2 is the same as described in the first embodiment.

The high-frequency transmission line shown in FIG. 5 greatly improves reflection loss at the bending portions 14*a* and 14*b* thereof so as to obtain better high-frequency transmission characteristics like those shown in FIGS. 1, 3 and 4. Accordingly, as shown in FIG. 5, the provision of two bending portions 14*a* and 14*b* or more in the transmission line 1 allows a high-frequency transmission line capable of transmitting signals without increasing reflection loss, wherever and in whichever directions the signal input line is positioned with regard to the optical modulator, to be provided.

Then, the first example of the application of the high-frequency transmission line according to the preset invention to an optical module is described with reference to FIG. 6.

Figure 6:
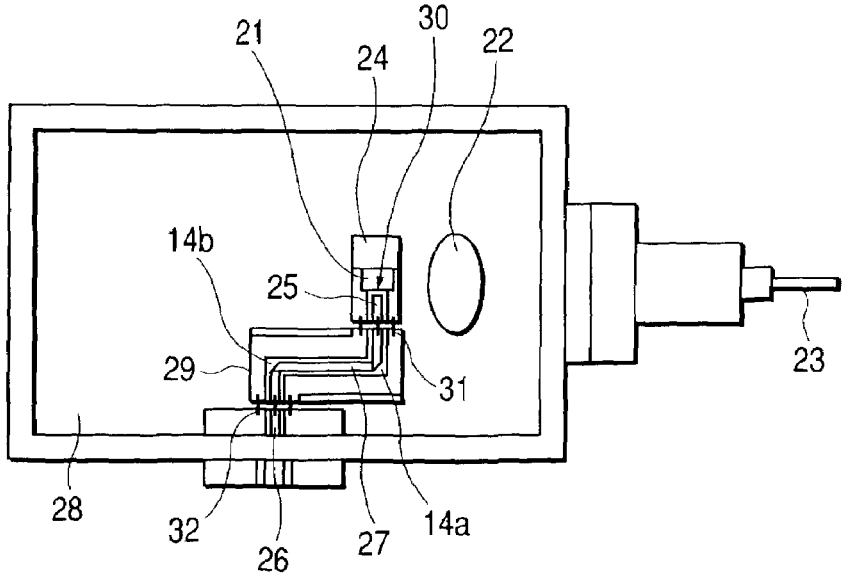
FIG. 6 is a plan view of the first example of an optical module incorporating the high-frequency transmission line according to the present invention.

FIG. 6 is a plan view of the first example of the optical module incorporating the high-frequency transmission line according to the present invention. In this example, among the transmission lines to connect the signal input line of the module package 28 with the transmission line 25 of the modulator integrated semiconductor laser 21, the high-frequency transmission line of the invention is adopted for the transmission line 27 arranged in the relay substrate 29. In this example, it is exemplified that the transmission line 25 arranged in the substrate 24 with the optical modulator integration semiconductor laser 21 carried on is incapable of being linearly connected to the transmission line 26 arranged in the module package 28. This example is arranged such that the light emitted from the semiconductor laser is adjusted through the sole lens 22 so as to be focused on the end portion of the optical fiber 23, so that displacement occurs between the positions of the semiconductor laser 21 and the transmission line 26 arranged in the package module 28 or the high-frequency input terminal so as to make it impossible to use a relay terminal whose transmission line is linearly arranged. Namely, in this example, a relay substrate 29 provided with the high-frequency transmission line shown in FIG. 5 is adopted. The high-frequency transmission line 27 provided with two bending portions 14 is disposed between the transmission lines 25 and 26, which lines are electrically connected to each other through bonding wires 31 and 32. This makes the transmission line better at high-frequency characteristics, which in turn improves the characteristics of the optical module.

The arrangement of the transmission line 27 according to this first example is the same as shown in FIG. 5, which arrangement is provided with two or more bending portions and is effective especially when the modulator integration semiconductor laser 21 (optical modulator) is displaced from the signal input line of the module package as well as the propagation direction of the optical signal is not in parallel to or vertical to the electric signal transmission direction.

Then, the second example of the optical module incorporating the high-frequency transmission line according to the invention is described with reference to FIG. 7.

Figure 7:
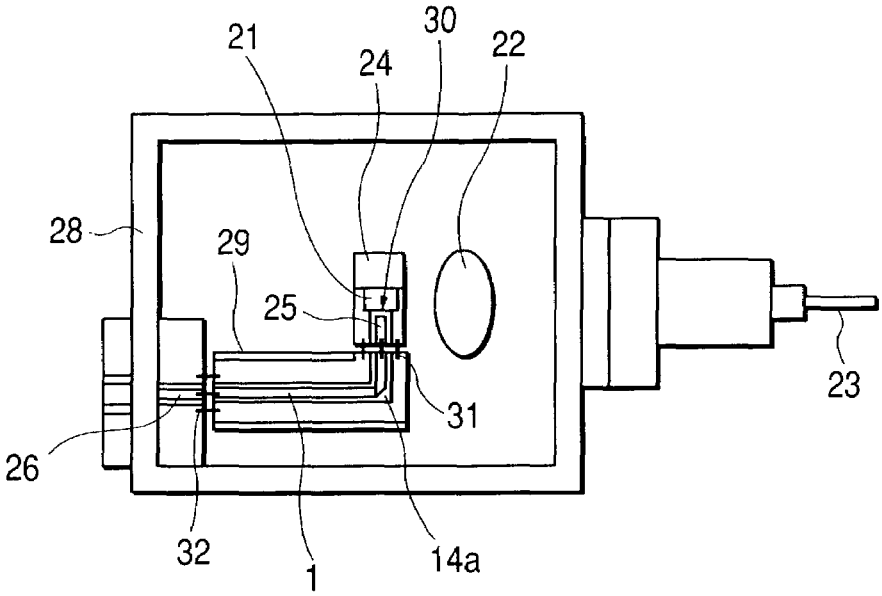
FIG. 7 is a plan view of the second example of an optical module incorporating the high-frequency transmission line according to the present invention.
Figure 8:
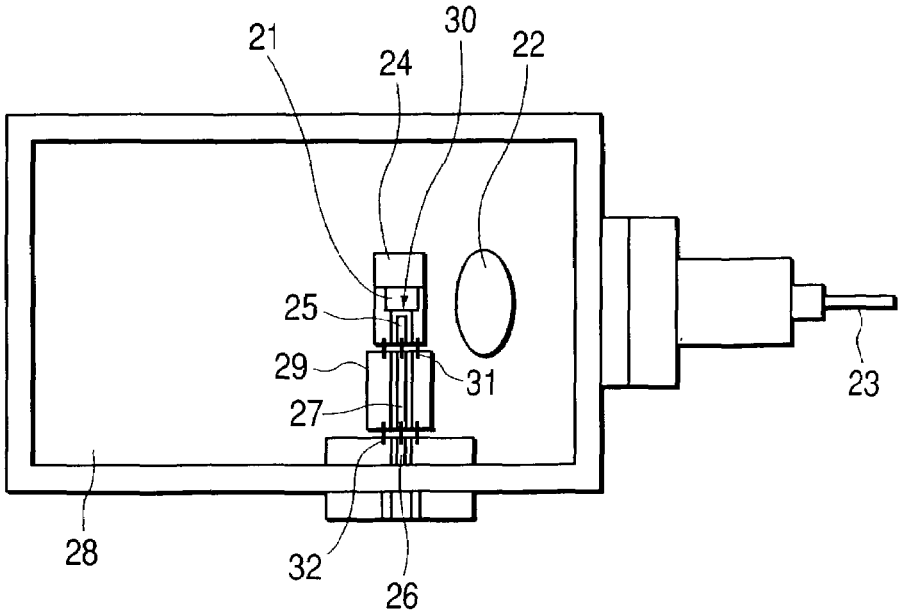
FIG. 8 PRIOR ART
FIG. 8 is an upper surface view of the inside of the prior optical module.

FIG. 7 is a plan view of the second example of the optical module incorporating the high-frequency transmission line according to the invention. This example, in the same way as shown in FIG. 6, relates to the application of the high-frequency transmission line of the invention to the optical module. The high-frequency transmission line adopted for this example has one bending portion, which transmission line corresponds to that shown in FIG. 1. The arrangement of the transmission line according to this example is effective especially when the input line of the high-frequency electric signal is in parallel to the transmission direction of the optical signal or when the electric signal is supplied from the rear portion of the module package, as shown in the drawing.

According to the high-frequency transmission line of the invention, the provision of as many bending portions as appropriate in appropriate portions of the transmission line allows a transmission line of better high-frequency characteristics to be realized, wherever or in whichever directions the signal input line of the module package is positioned. Accordingly, an optical module of a higher bit rate that is better at high-frequency characteristics is provided.

As described above, the bending portion of the high-frequency transmission line according to the invention restrains reflection in the high-frequency area from increasing, which allows a transmission line of improved high-frequency characteristics and an optical transmission module incorporating the same line to be provided and enhances the latitude of optically and structurally designing an optical module so as to provide such module as being lower in production cost and of smaller sizes.

The invention may be embodied in other specific forms without departing from the spirit or essential characteristics thereof. The present embodiment is therefore to be considered in all respects as illustrative and not restrictive, the scope of the invention being indicate by the appended claims rather than by the foregoing description and all changes which come within the meaning and range of equivalency of the claims are therefore intended to be embraced therein.

What is claimed is:

1. An optical module comprising:

a module package;

an optical modulator integrated semiconductor laser contained in said module package;

a lens to irradiate light emitted from said semiconductor laser such that said light is substantially focused on an end portion of an optical fiber provided in an exterior of said module package; and a high-frequency transmission line to supply a high-frequency signal input from said exterior of said module package to said semiconductor laser, wherein said high-frequency transmission line comprises:

a substrate;

a signal wiring conductor provided on or in said substrate, said signal wiring conductor having a first portion;

a second portion of said signal wiring conductor provided on or in said substrate and disposed such that said second portion of said signal wiring conductor substantially intersects with said first portion of said signal wiring conductor; and a bending portion of said signal wiring conductor that interconnects said first and second portions of said signal wiring conductor, wherein an outer side of said bending portion of said signal wiring conductor is chamfered so as to provide an outer signal conductor intermediary side and a triangular conductor is disposed to an inner side of said bending portion so as to provide an inner signal conductor intermediary side, and wherein given that length of said outer signal conductor intermediary side is defined as a and length of said inner signal conductor intermediary side is defined as b and width of said respective first and second portions of said signal wiring conductors is defined as c, it is arranged such that a is greater than (b+c×square root of 2).

2. An optical module comprising:

a module package;

an optical modulator integration semiconductor laser contained in said module package;

a lens to irradiate light emitted from said semiconductor laser such that said light is substantially focused on an end portion of an optical fiber provided in an exterior of said module package and a high-frequency transmission line to supply a high-frequency signal input from said exterior of said module package to said semiconductor laser, wherein said high-frequency transmission line comprises:

a substrate;

a signal wiring conductor provided on or in said substrate and having a first portion;

a second portion of said signal wiring conductor provided on or in said substrate and disposed such that said second portion of said signal wiring conductor substantially intersects with said first wiring conductor; and a bending portion of said signal wiring conductor that interconnects said first and second portions of said signal wiring conductor, wherein an outer side of said bending portion of said signal wiring conductor is chamfered so as to provide an outer signal conductor intermediary side and a triangular conductor is disposed to an inner side of said bending portion so as to provide an inner signal conductor intermediary side, and wherein given that width of said respective first and second portions of said signal wiring conductor is defined as c and length of said inner signal conductor intermediary side projected to a plane crossing with one of said first and second portions of said signal wiring conductor is defined as e and length of said outer signal conductor intermediary side projected to said plane is defined as f, it is arranged such that f is greater than (c+e).

3. An optical module comprising:

a module package;

an optical modulator integration semiconductor laser contained in said module package;

a lens to irradiate light emitted from said semiconductor laser such that said light is substantially focused on an end portion of an optical fiber provided in an exterior of said module package; and a high-frequency transmission line to supply a high-frequency signal input from said exterior of said module package to said semiconductor laser, wherein said high-frequency transmission line comprises:

a substrate;

a signal wiring conductor provided on or in said substrate, said signal wiring conductor having a first portion;

a second portion of said signal wiring conductor provided on or in said substrate and disposed such that said second portion of said signal wiring conductor substantially intersects with said first portion of said signal wiring conductor; and a bending portion of said signal wiring conductor that interconnects said first and second portions of said signal wiring conductor, wherein an outer side of said bending portion of said signal wiring conductor is chamfered so as to provide an outer signal conductor intermediary side and a triangular conductor is disposed to an inner side of said bending portion so as to provide an inner signal conductor intermediary side, and wherein a point at which an outer signal conductor side of said first portion of said signal wiring conductor intersects with said outer signal conductor intermediary side is defined as a first intersecting point and a point at which an inner signal conductor side of said first portion of said signal wiring conductor intersects with said inner signal conductor intermediary side is defined as a second intersecting point, while a point at which said outer signal conductor side of said second portion of said signal wiring conductor intersects with said outer signal conductor intermediary side is defined as a third intersecting point and a point at which said inner signal conductor side of said second portion of said signal wiring conductor intersects with said inner signal conductor intermediary side is defined as a fourth intersecting point, and wherein an angle that a first line to connect said first and second intersecting points makes with a second line to connect said third and fourth intersecting points is greater than 90°.

4. An optical module comprising:

a module package;

an optical modulator integration semiconductor laser contained in said module package;

a lens to irradiate light emitted from said semiconductor laser such that said light is substantially focused on an end portion of an optical fiber provided in an exterior of said module package; and a high-frequency transmission line to supply a high-frequency signal input from said exterior of said module package to said semiconductor laser, wherein said high-frequency transmission line comprises:

a substrate;

a signal wiring conductor provided on or in said substrate and having a first portion;

a second portion of said signal wiring conductor provided on or in said substrate and disposed such that said second portion of said signal wiring conductor substantially intersects with said first portion of said signal wiring conductor; and a bending portion of said signal wiring conductor that interconnects said first and second portion of said signal wiring conductor, wherein an outer side of said bending portion of said signal wiring conductor is chamfered so as to provide an outer signal conductor intermediary side and a triangular conductor is disposed to an inner side of said bending portion so as to provide an inner signal conductor intermediary side such that said inner signal conductor intermediary side runs in parallel to said outer signal conductor intermediary side, and wherein given that width of said respective first and second portions of said signal wiring conductor is defined as c and width running crosswise between said outer and inner signal conductor intermediary sides is defined as g, it is arranged such that g is less than c divided by square root of 2.

* * * * *